United States Patent [19]

Pusic

[11] Patent Number: 5,022,097

[45] Date of Patent: Jun. 11, 1991

[54] AUTOMATED TOILET SEAT CLEANING SYSTEM

[76] Inventor: Pavo Pusic, Moluntska 6, Dubrovnik, Yugoslavia, 50000

[21] Appl. No.: 481,805

[22] Filed: Feb. 20, 1990

Related U.S. Application Data

[63] Continuation of Ser. No. 261,990, Oct. 25, 1988, abandoned.

[51] Int. Cl.[5] ..... A47K 13/00

[52] U.S. Cl. ..... 4/233

[58] Field of Search ..... 4/233

[56] References Cited

U.S. PATENT DOCUMENTS 1,630,932 5/1927 Friedrich ..... 4/233

1,800,261 4/1931 Monoghan ..... 4/233

2,592,167 4/1952 Monoghan ..... 4/233

3,815,158 6/1974 Schnyder et al. ..... 4/233 X 4,785,482 11/1988 Nelva-Pasgual et al. ..... 4/233

FOREIGN PATENT DOCUMENTS 8303532 10/1983 World Int. Prop. O. ..... 4/233

*Primary Examiner*—Charles E. Phillips

*Attorney, Agent, or Firm*—Marks Murase & White

[57] ABSTRACT

The present invention discloses an economical yet sturdy and reliable automated toilet seat cleaning system including a system housing, a movable toilet seat, a plurality of cleaning brushes, sources of water and disinfectant, and drying elements all of whose functions are electronically controlled.

8 Claims, 2 Drawing Sheets

AUTOMATED TOILET SEAT CLEANING SYSTEM

This application is a continuation of application Ser. No. 07/261,990, filed Oct. 25, 1988.

The present invention relates to toilet seat cleaning systems and, more particularly, to a novel electronically controlled device for toilet seat cleaning having a built-in toilet seat and means for automatically washing and drying the same.

BACKGROUND OF THE INVENTION

The significance of toilet seat hygiene and, in particular, of public toilet seat hygiene came to people's attention along with the understanding of the concept of infection transfer. Since then, many different methods have been applied in order to maintain the required hygiene standards, particularly in the case of public toilets. In addition to the use of mostly manually applied disinfectants, many automated devices have been invented, either for washing an entire rest room or only one toilet seat. Most of these have not been applied on a large scale because of their many various disadvantages. Therefore, the vast majority of public toilets are still manually washed and dried.

Most of the devices known in the prior art have the significant disadvantage of being expensive, either to manufacture or to maintain, because the systems demand the replacement of an entire toilet or the use of expensive fluids. In particular, the most sophisticated toilet seat washing systems do not provide a satisfactory solution for fast and inexpensive toilet seat washing and drying and they demand significant changes in existing rest room structure.

SUMMARY OF THE INVENTION

It is therefore an object of the present invention to provide an automated toilet seat cleaning system which will overcome the limitations and disadvantages of the currently used systems and of the systems disclosed in the prior art.

It is a further object of the present invention to provide an automated toilet seat cleaning system which has the ability to wash and dry an entire toilet seat within a reasonable period of time and using a reasonable amount of water and disinfecting agent without any problematic consequences, such as water being dropped on the floor or harmful disinfectant being left on the toilet seat.

Since toilet bowls are mostly considered a capital expense and therefore are not replaced frequently, it is another object of the present invention to provide an automated toilet seat cleaning system which is compatible with existing toilet bowls and which can be mounted without a change of their shape or plumbing.

It is also an object of the present invention to provide an energy, water, and disinfectant efficient system which, after installation, does not require any maintenance except a periodic disinfectant refill.

DETAILED DESCRIPTION OF THE INVENTION

Figure 1:
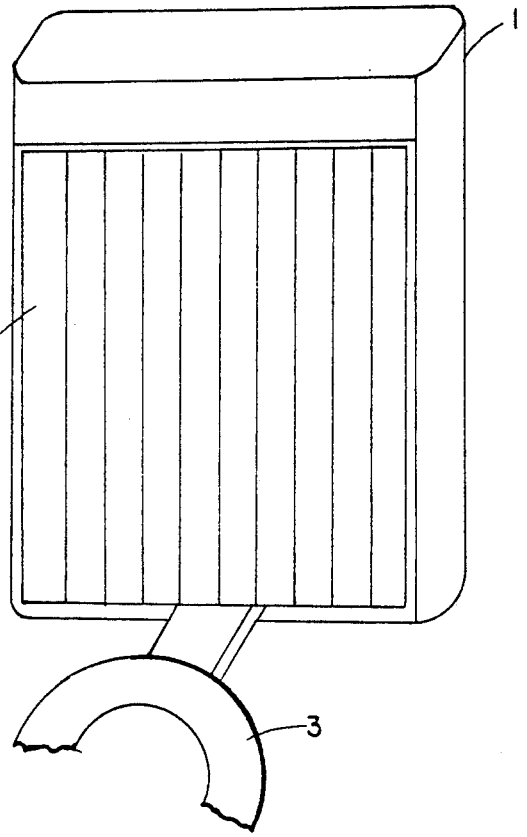
FIG. 1 is a perspective view of the system's housing and toilet seat.
Figure 2:
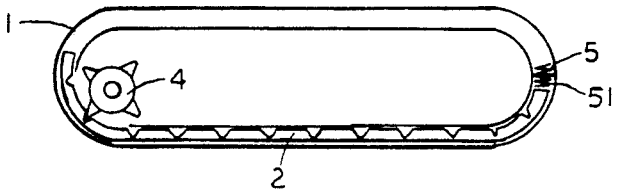
FIG. 2 is the top view of the system's housing, showing the upper door frame and its position when the door is closed.
Figure 4:
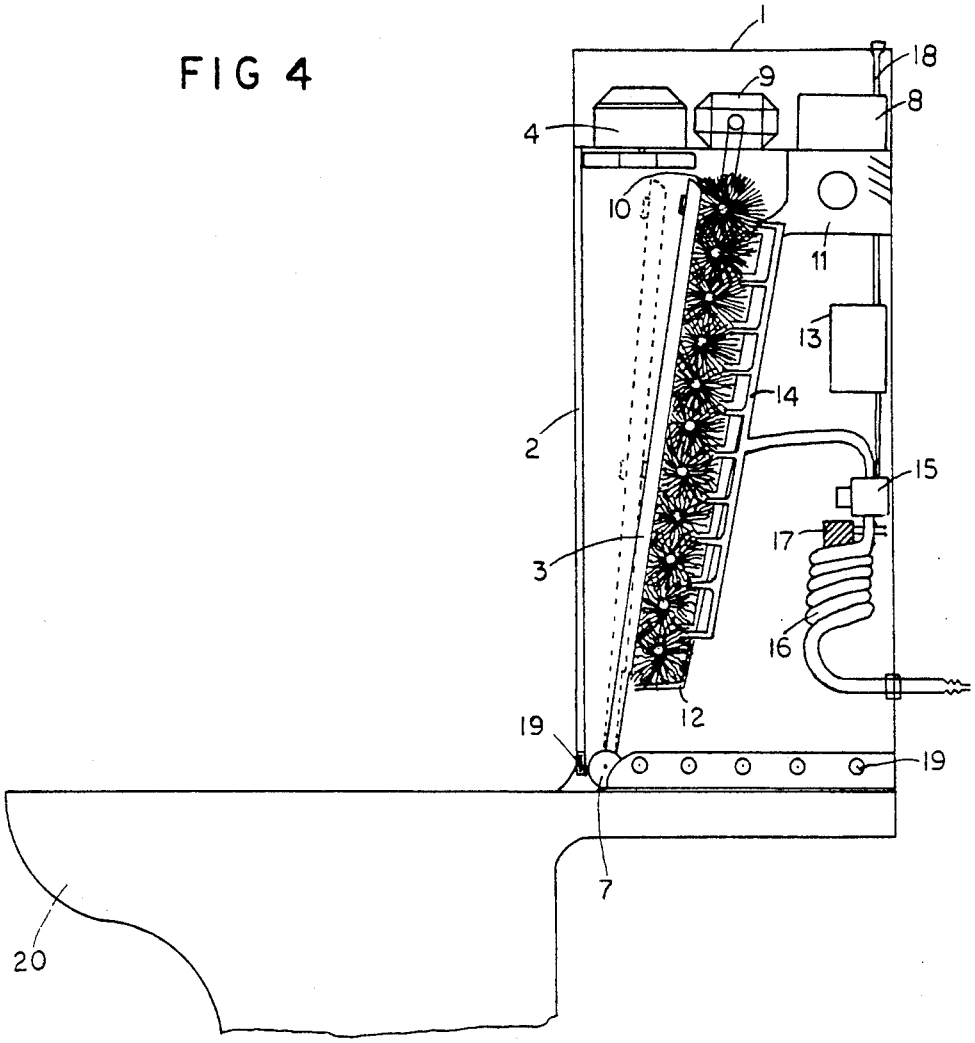
FIG. 4 is the right side view of the system housing mounted on a toilet bowl, showing its parts in a washing position.
Figure 5:
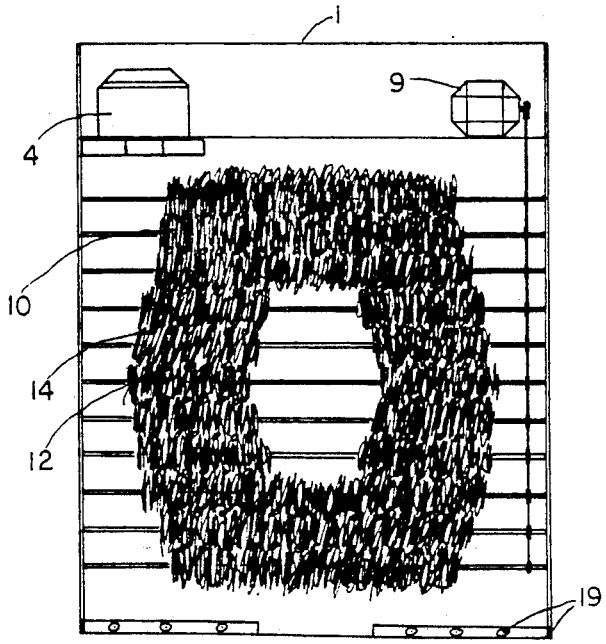
FIG. 5 is the front view of the system's housing, showing the position of the washing brushes.
Figure 6:
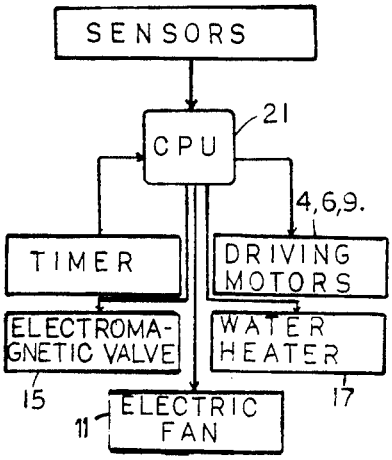
FIG. 6 is a block diagram of the system as disclosed by this invention.

Referring specifically to the drawings, FIG. 1 illustrates one embodiment of the present invention. With reference to FIG. 1 and in accordance with the invention, there is shown a system housing 1, its sliding door 2, and a toilet seat 3 in the down position. The sliding door 2, as shown in FIGS. 1 and 2, is preferably made of hard rubber and is driven by electric motor 4, mounted on a frame 23. As shown in FIGS. 2, 4, and 5, over the small rotating cylinders 19 located on the bottom of the housing by a portion of the driving means located under the frame. The door 2 is designed, when closed, to prevent any water leakage outside of the system's housing 1.

All of the tasks to be performed are electronically guided by the system's control box 8, shown in FIG. 4, and all electrical components are properly isolated and insulated so that any contact of electricity and water is impossible so as to avoid any hazardous situations.

The system may be equipped with photo sensor(s) (not shown) which could be located anywhere inside the toilet stall and connected to the control box 8. Such photo sensor(s) may be used to signal the Central Processing Unit (CPU) 21 when to start the washing and drying process. Such starting instructions could also be signalled by some other means, such as the toilet flushing lever or the lock to the toilet stall door.

Such starting instructions would signal to CPU 21 that the washing and drying process can occur. The CPU 21 then activates the electric motor 4, shown in FIGS. 2, 4 and 5, thereby driving the sliding door 2 clockwise into the housing's rear wall until it reaches the spring 5, shown in FIG. 2, which, when pressed, activates an electromagnetic sensor which further signals to the CPU 21 that the door 2 is properly opened. The spring 51 mentioned later in this description is located on the opposite side from spring 5 and acts according to the same principle when door 2 is closed.

Figure 3:
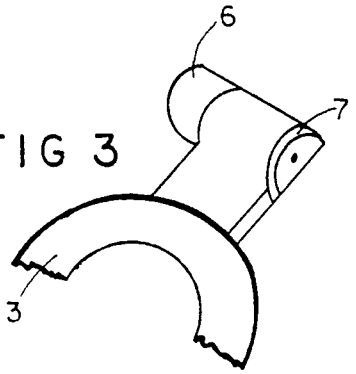
FIG. 3 is a perspective view of the toilet seat, its driving electric motor, and its support frame.

As soon as the door's 2 left edge presses against spring 5, the electric motor 4 stops leaving the door 2 inside the housing's rear wall so that the front of the system,s housing is open. Electric motor 6, shown in FIG. 3, then raises the toilet seat 3 inside the system's housing 1 through the front opening. The toilet seat 3 is lifted by electric motor 6 which is built into support frame 7, as shown in FIG. 3. As soon as the toilet seat 3 reaches the position in front of the washing brushes 10, FIGS. 4 and 5, electric motor 6 stops leaving the seat 3 leaning against the brushes 10 as shown in FIG. 4. Electric motor 4 now drives the door 2 back to a closed position, thereby closing the front opening. The door 2 stops when its right edge presses the spring 51 shown in FIG. 2. As shown in FIG. 4, the system is equipped with water heating device 17 which starts heating the water in the spiral part of the water pipe 16 at the very beginning of the process, i.e. simultaneously with the first mentioned activity of the electric motor 4, and continues the heating during the washing procedure. As soon as door 2 is closed, the system's electro-magnetic valve 15, FIG. 4, is activated thereby enabling water from pipe 16 and disinfecting agent from container 13, which can be refilled through its opening 18 as shown in FIG. 4, to flow forward into the spray nozzles 14, FIGS. 4 and 5.

It is assumed that the system's water pipe 16 is connected to an external pressured water pipe. If needed, however, a small actuator can be installed to provide the necessary water pressure. A certain limited amount of disinfecting agent is released from its container and is mixed with the water during the washing procedure. Simultaneously with the opening of the electromagnetic valve 15, a high speed electric motor 9 is activated thereby rotating washing brushes 10, FIGS. 4 and 5. The brushes 10 rotate and wash the toilet seat 3 with a mixture of water and disinfecting agent sprayed through the plurality of spray nozzles 14. After a predetermined period of time, the electric motor 9 stops causing all of the brushes 10 to stop, and the electromagnetic valve simultaneously closes thereby ending the flow of water and disinfecting agent. The water heating device 17 is switched off and the electric motor 6 moves the toilet seat 3 towards the housing's sliding wall far enough so that it loses contact with the brushes, as shown in FIG. 4 where this position of the toilet seat 3 is shown in dotted lines.

During the seat washing procedure, the water used is released into the toilet bowl 20 through an opening (not shown) in the bottom of the system's housing 1 thereby also disinfecting the toilet bowl 20. The used water then remains inside the bowl until the next flushing thereby having a further positive sanitary effect. As soon as the toilet seat 3 is moved forward, hot air fan 11, FIG. 4, is activated and blows hot air toward the toilet seat 3 through the plurality of nozzles 12 which are located in between the brushes 10. The nozzles 12 are located in line with the brushes, axles in order to obtain the best possible drying effect without being damaged by the raised toilet seat 3. After a predetermined period of time, the fan's 11 activity is stopped and the electric motor 4 is activated.

The motor 4 now drives the door 2 clockwise as previously described, leaving a front opening through which the toilet seat 3 is lowered back to its starting position on the toilet bowl 20 by the electric motor 6. After the toilet seat 3 returns from the system's housing 1, the electric motor 4 drives the door 2 counterclockwise to its closed position until its right edge presses against spring 51. Once the toilet seat 3 is back on the toilet bowl 20 and the housing's front opening is closed, all of the system's functions return back to a stand-by position until the next washing/drying process is required.

It will be understood that the present invention has been described in relation to a particular embodiment, herein chosen for the purpose of illustration, and that the claims are intended to cover all changes and modifications apparent to those skilled in the art which do not constitute a departure from the scope and spirit of the present invention. It is also to be understood that the present system can be newly constructed or adapted and mounted in existing toilet bowl tanks. Therefore, it is to be understood that the entire unit's housing can be manufactured smaller in depth than it may appear from the disclosed drawings wherein a larger depth is used for the purpose of better illustrating the present invention.

I claim:

1. An automated toilet seat closing system comprising:

a system housing mounted on a toilet bowl including a liquid-tight door and driving means mounted on a frame for opening and closing said door, said door laterally driven into said housing in a retracted position and back into closed position by the driving means under the frame over rotating cylinders located in the bottom of a housing wall;

a movable toilet seat and electrical means for lifting and lowering said toilet seat, said toilet seat lifted into a vertical position and lowered into a resting horizontal position by said electrical means around a support frame mounted on a rear end of said toilet seat;

a plurality of rotating brushes for cleaning said toilet seat and electrical means for operating said brushes, said brushes mounted for rotation about horizontal axes inside said system housing and operated by said electrical means;

a liquid delivery means for spraying a liquid on said toilet seat, said liquid delivery means including a liquid heating means for heating said liquid, a disinfectant storing means for storing said liquid, and an electromagnetic means for initiating and stopping the flow of said liquid, all enclosed within said system housing;

an air delivery means for drying said toilet seat, said air delivery means including an air heating means and air blowing means all enclosed within said system housing;

means for removing said sprayed liquid from within said system housing;

means for automatically activating and controlling driving of said liquid-tight door, lifting and lowering of said toilet seat, rotating of said brushes, opening and closing of said electromagnetic means, heating of said liquid, and heating and blowing of said air.

2. The system according to claim 1, wherein said electrical means for lifting and lowering said toilet seat are mounted inside said support frame and perform a rotary motion which causes lifting and lowering of said toilet seat to be performed while said support frame remains stationary.

3. The system according to claim 1, wherein said liquid is comprised of a mixture of water and disinfectant and wherein said liquid delivery means include means for mixing said water and disinfectant and means for pressurizing said liquid.

4. The automated toilet seat cleaning system of claim 1, further comprising a cleaning unit which includes the plurality of rotatable brushes and a drive means for rotating the brushes, the drive means being controlled by the control unit.

5. The automated toilet seat cleaning system of claim 1, wherein the liquid delivery means includes a liquid supply, a plurality of spray nozzles for spraying liquid from the liquid supply on the toilet seat and a valve for controlling the flow of liquid from the liquid supply to the spray nozzle, the valve being controlled by the control unit.

6. The automated toilet seat cleaning system of claim 1, wherein the air delivery means is controlled by the control unit, and includes a hot air fan for generating and blowing hot air and a plurality of nozzles for directing hot air into the toilet seat.

7. The automated toilet seat cleaning system of claim 1, wherein the laterally movable liquid-tight door is made of hard rubber.

8. The automated toilet seat cleaning system of claim 1, further comprising a control unit which controls the system such that in response to an external signal, the door is laterally opened, the toilet seat is raised to the up position, the door is laterally moved to the closed position, the cleaning unit disinfects and dries the toilet seat, the door is laterally opened, the toilet seat is lowered to the down position, and the door is laterally moved to the closed position.

* * * * *